US008002271B2

(12) United States Patent
Ueyama

(10) Patent No.: US 8,002,271 B2
(45) Date of Patent: Aug. 23, 2011

(54) IMAGE FORMING APPARATUS WITH CURL CORRECTION USING GUIDE RIBS

(75) Inventor: Junki Ueyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 514 days.

(21) Appl. No.: 11/442,965

(22) Filed: May 31, 2006

(65) Prior Publication Data

US 2007/0001368 A1 Jan. 4, 2007

(30) Foreign Application Priority Data

May 31, 2005 (JP) ..... 2005-159429

(51) Int. Cl.
*B65H 29/70* (2006.01)

(52) U.S. Cl. ..... 271/188; 271/272; 162/271

(58) Field of Classification Search ..... 271/278, 271/264, 272, 306, 189, 188; 162/197, 271; 399/406

See application file for complete search history.

(56) References Cited

U.S. PATENT DOCUMENTS

| | | | | |
|---|---|---|---|---|
| 6,896,432 | B2 * | 5/2005 | Ohyama | 400/642 |
| 7,556,260 | B2 * | 7/2009 | Yoshimoto et al. | 271/188 |
| 2003/0189631 | A1 * | 10/2003 | Hoshino et al. | 347/218 |
| 2006/0044633 | A1 * | 3/2006 | Iwago et al. | 358/498 |
| 2009/0324311 | A1 * | 12/2009 | Matsumoto | 271/264 |

FOREIGN PATENT DOCUMENTS

| | | |
|---|---|---|
| JP | 3-251474 | 11/1991 |
| JP | 4-322278 | 11/1992 |
| JP | 6-127785 | 5/1994 |
| JP | 7-179258 | 7/1995 |
| JP | 9-295401 | 11/1997 |
| JP | 11-139651 | 5/1999 |
| JP | 11-249356 | 9/1999 |
| JP | 2003-146465 | 5/2003 |
| JP | 2003146465 A * | 5/2003 |
| JP | 2004-75305 | 3/2004 |

OTHER PUBLICATIONS

Japanese Office Action, with English translation, Japanese Patent Application No. JP 2005-159429, mailed Sep. 18, 2007.

* cited by examiner

*Primary Examiner* — Gerald W McClain
(74) *Attorney, Agent, or Firm* — Baker Botts L.L.P.

(57) ABSTRACT

An image forming apparatus that includes: an image forming unit that forms an image on a surface of a conveyed sheet; a guide that guides the sheet conveyed from the image forming unit; a correction roller located downstream of the guide in a conveyance direction of the sheet, the correction roller correcting a curl of the sheet conveyed; a plurality of rollers disposed opposite the correction roller along the periphery of the correction roller, the rollers nipping the sheet with respect to the correction roller; and a guide member having a wheel that guides the sheet being guided by the guide and conveyed toward the correction roller.

11 Claims, 7 Drawing Sheets

IMAGE FORMING APPARATUS WITH CURL CORRECTION USING GUIDE RIBS

CROSS REFERENCE TO RELATED APPLICATION

This application claims priority from Japanese Patent Application No. 2005-159429, filed on May 31, 2005, the entire subject matter of which is incorporated herein by reference.

TECHNICAL FIELD

Aspects of the present invention relate to an image forming apparatus.

BACKGROUND

A conventional image forming apparatus including a copying machine, a printer and a facsimile uses an electrophotographic system. In the conventional image forming apparatus, a sheet, for which a toner image thermal fixing process has been finished, is curled. Thus, a curl correction roller for removing the curl is usually provided. There is one curl correction roller in which, along the periphery of a large-diameter correction roller, two rollers having a smaller diameter than the correction roller are located side-by-side and abutted against the correction roller (for example, refer to JP-A-7-179258). By this means, between the abutments of the two rollers with the correction roller, the sheet is conveyed along the periphery of the correction roller, whereby the curl is corrected by the curvature of the correction roller.

SUMMARY

However, while the sheet is being nipped between the correction roller and the smaller diameter rollers, the sheet curves to a large extent along the periphery of the correction roller. With this curvature, a portion of the sheet positioned upstream of the correction roller in a sheet conveyance direction comes into strong sliding contact with a guide and the like, which form a conveyance path, and a toner adheres to the guide and the like. In this way, when the toner adheres to the guide and the like, a sheet to be conveyed next may be tainted, in which case a user needs to disassemble and clean the image forming apparatus in order to remove the adhering toner. Also, there is the possibility that more toner may accumulate into a lump on a portion to which the toner adheres, such as the guide and the like, and that a jam may be caused by the sheet being caught on the lump. For this reason, the user must remove the adhering toner, which causes such possibilities.

Aspects of the present invention provide an image forming apparatus, which can reduce a burden on a user.

According to an aspect of the invention, there is provided an image forming apparatus including: an image forming unit that forms an image on a surface of a conveyed sheet; a guide that guides the sheet conveyed from the image forming unit; a correction roller located downstream of the guide in a conveyance direction of the sheet, the correction roller correcting a curl of the sheet conveyed; a plurality of rollers disposed opposite the correction roller along the periphery of the correction roller, the rollers nipping the sheet with respect to the correction roller; and a guide member having a wheel that guides the sheet being guided by the guide and conveyed toward the correction roller.

According to the aspect of the invention, as the image forming apparatus includes the guide member having the wheel that guides the sheet toward the correction roller, the wheel, while rotating, smoothly guides the sheet to the correction roller. In a case in which the surface of the sheet formed with the toner image is conveyed facing the wheel, on the upstream side of the correction roller in the conveyance direction, the possibility that the sheet may come into strong sliding contact with the guide and that a toner adheres to the guide is reduced. Consequently, it is possible to reduce the possibility that a sheet to be conveyed next may be tainted and also the possibility that a toner may accumulate on the guide into a lump that can cause a jam. As a result, it is possible to reduce a burden on a user.

DETAILED DESCRIPTION

Hereafter, a description will be given, with reference to the drawings, of aspects in a case in which the invention is applied to a laser printer as an image forming apparatus.

(a) Overall Configuration

First, a description will be given, with reference to FIGS. 1 and 2, of an overview of a laser printer, as an image forming apparatus, according to this aspect.

Figure 1:
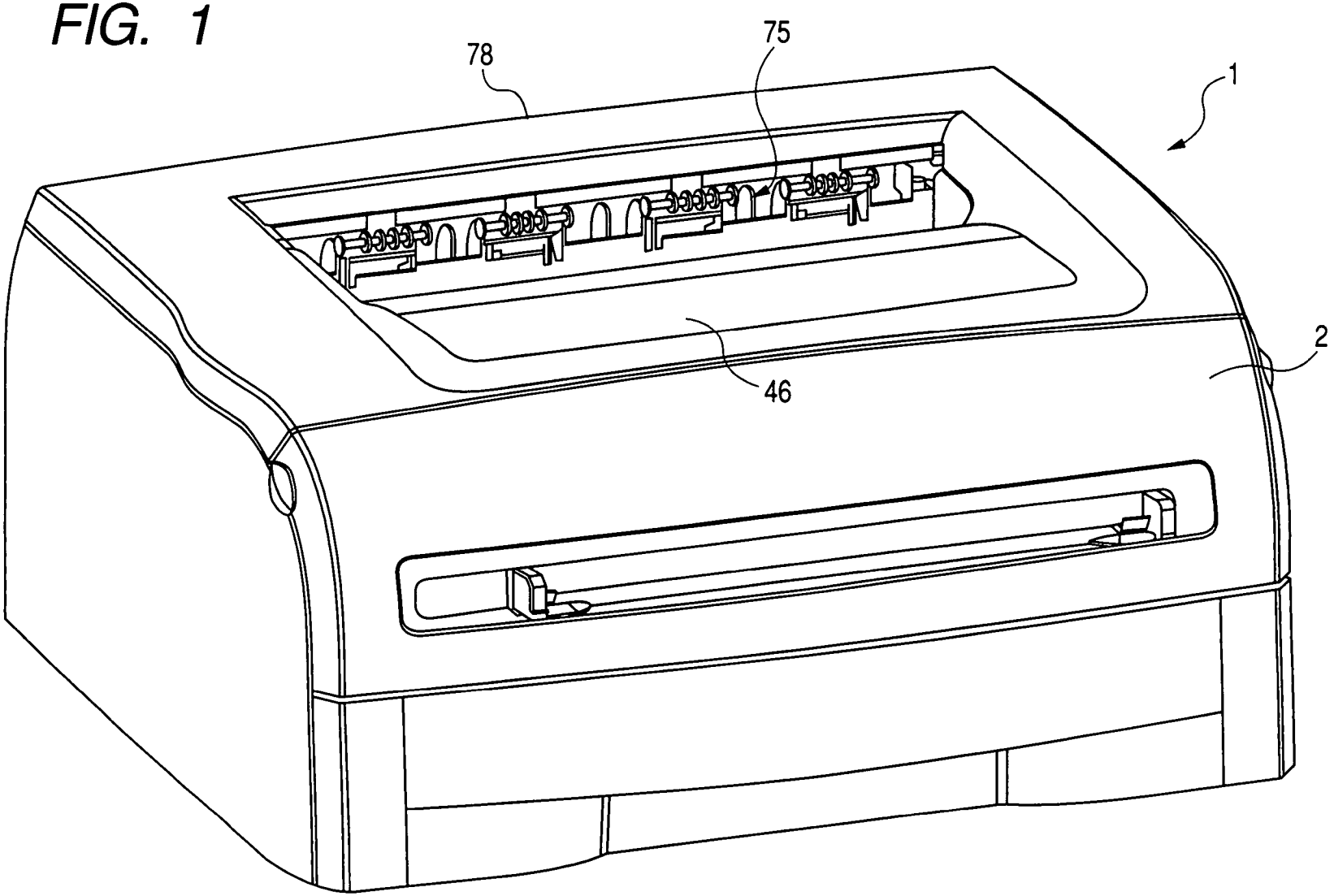
FIG. 1 is an external view seen from the front of a laser printer as an image forming apparatus according to an aspect of the invention.

FIG. 1 is a perspective view showing an external appearance of a laser printer 1 (hereafter also referred to as a printer 1). FIG. 2 is a sectional side view of the printer 1. In the following description, the right side of the plane of FIG. 2 is the front of the printer 1, and the left side of the plane is the rear of the printer 1.

As shown in FIG. 1, the laser printer 1 includes a generally box-shaped body casing 2. The casing 2 includes therein a feeder section 4 for feeding paper 3 in the form of sheets, an image forming unit 5 for forming an image on the paper 3 fed, and the like. Also, an opening 48, through which a process cartridge 17 can be attached/detached, is provided in the upper portion of the front (a side wall) of the body casing 2. A front cover 50 that covers the opening 48 can be opened/closed.

Figure 2:
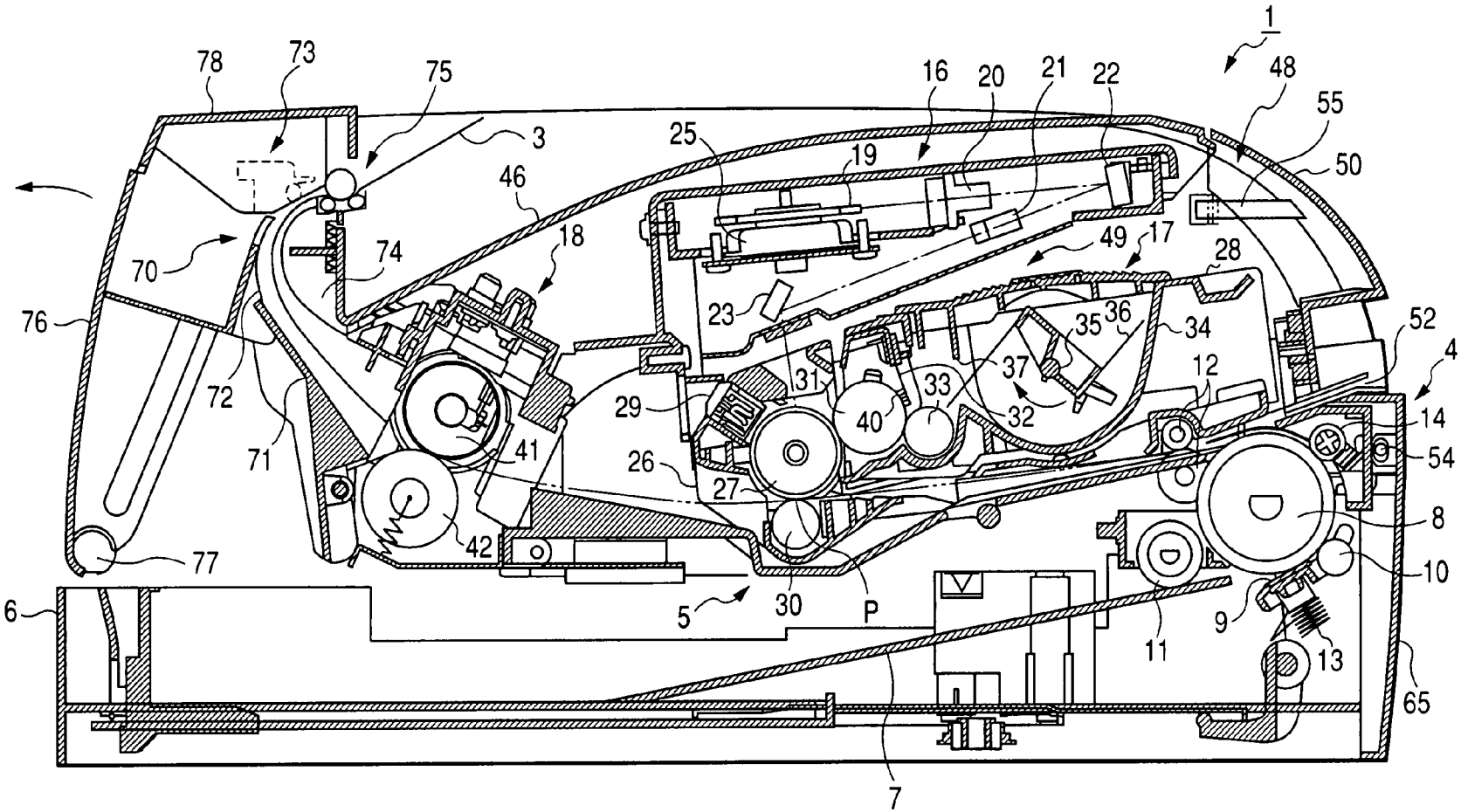
FIG. 2 is a sectional side view of the printer.

As shown in FIG. 2, the feeder section 4 includes a paper feed cassette 6, a paper pressing plate 7 provided in the paper feed cassette 6, a pickup roller 11 provided above one side end of the paper feed cassette 6, a paper feed roller 8, a separation pad 9, a pinch roller 10 facing the paper feed roller 8, a paper dust removing roller 14, and registration rollers 12 provided on the downstream side of the paper dust removing roller 14 in a conveyance direction of the paper 3.

The paper feed cassette 6, which is detachably attached to the inner bottom of the body casing 2, is used to store the paper 3 stacked therein. A front wall 65 integrally formed of a synthetic resin material is provided at the front end of the paper feed cassette 6. The front wall 65 covers the whole width of the front lower portion of the body casing 2 when the paper feed cassette 6 is attached to a regular attachment position (in the condition shown in FIGS. 1 and 2). The front wall 65 is disposed in a position below the front cover 50. The paper feed cassette 6, when it is replenished with the paper 3 or in a like case, is pulled out to the front side of the printer 1 (to the right in FIG. 2). At this time, the feeder section 4 is separated from a portion between the paper feed roller 8 and the separation pad 9, whereby the pinch roller 10, the separation pad 9 and a spring 13 located on the back of the separation pad 9 are pulled out integrally with the paper feed cassette 6.

The paper pressing plate 7 is swingably supported at an end far from the paper feed roller 8, thereby making an end near to the paper feed roller 8 movable in an up and down direction. The paper pressing plate 7 is urged upward by a spring (not shown). For this reason, the paper pressing plate 7, as the amount of paper 3 stacked increases, swings downward against the urging force of the spring with the end far from the paper feed roller 8 acting as its fulcrum.

The pickup roller 11 is set in such a way as to come into contact with a paper 3 stacked uppermost in the paper feed cassette 6 on the paper pressing plate 7, whereby the paper feed roller 8 feeds the paper 3 to a conveyable position (a position between the paper feed roller 8 and the separation pad 9).

The separation pad 9 is located at a position facing the paper feed roller 8 and is pressed toward the paper feed roller 8 by the spring 13 located on the underside of the separation pad 9. Also, the separation pad 9 has the function of preventing a plurality of paper 3 from being supplied into the conveyance path one on top of the other. That is, the paper 3 fed by the pickup roller 11 comes into contact with the paper feed roller 8 and the separation pad 9. At this time, as an appropriate frictional force is applied between the separation pad 9 and the paper 3, even when the plurality of paper 3 is fed to the separation pad 9 by the pickup roller 11, each paper 3 other than the paper 3 positioned uppermost is retained by the separation pad 9. For this reason, each sheet of paper 3 is individually supplied from the paper feed roller 8. Then, the paper 3 fed by the paper feed roller 8 is inverted in such a way as to be turned over in the vicinity of the front end of the paper feed cassette 6. After paper dust is removed by the paper dust removing roller 14, the paper 3 is fed to the registration rollers 12.

The registration rollers 12, after registering the paper 3, convey the paper 3 to a transfer position P which is located between a photosensitive drum 27 and a transfer roller 30. At the transfer position P, a toner image on the photosensitive drum 27 is transferred to the paper 3.

The image forming unit 5 is configured to include a scanner unit 16, the process cartridge 17, a fixing unit 18 and the like.

The scanner unit 16, which is provided in the upper portion of the body casing 2, includes a laser emission portion (not shown), a polygon mirror 19 that is rotary driven by a scanner motor 25, lenses 20 and 21, reflecting mirrors 22 and 23, and the like. A laser beam based on prescribed image data is emitted from the laser emission portion. The laser beam is passed through or reflected off the polygon mirror 19, lens 20, reflecting mirror 22, lens 21 and reflecting mirror 23 in the stated order, and thereby caused to irradiate the surface of the photosensitive drum 27 in the process cartridge 17 by rapid scanning.

Inside the body casing 2, am accommodation portion 49 communicating with the opening 48 is formed below the scanner unit 16. The process cartridge 17 is detachably attached to the accommodation portion 49. The process cartridge 17 includes a development cartridge 28 and a drum cartridge 26.

The development cartridge 28 includes a development roller 31, a layer thickness regulation blade 32, a toner supply roller 33, a toner box 34 and the like. Such a development cartridge 28 is detachably attached to the drum cartridge 26.

The inside of the toner box 34 is filled with a toner (developer). The toner in the toner box 34 is agitated by the rotation of an agitator 36, which is supported by a shaft 35 provided in the center of the toner box 34, in the direction indicated by an arrow (clockwise). The toner is then released from a toner supply opening 37 provided in the toner box 34.

The toner supply roller 33 is located at a side position of the toner supply opening 37 in such a way as to be rotatable counterclockwise. Also, the development roller 31 is located opposite the toner supply roller 33 in such a way as to be rotatable counterclockwise. The toner supply roller 33 and the development roller 31 are in contact with each other in such a condition as to somewhat compress each other.

The toner supply roller 33 has a metallic roller shaft covered with a roller made of a conductive foamed material. Also, the development roller 31 has a metallic roller shaft covered with a roller made of a conductive rubber material having no magnetic property. More specifically, the roller portion of the development roller 31 has a fluorine-containing urethane rubber or silicone rubber coating layer coated on the surface of the roller body, which is made of conductive urethane rubber or silicone rubber containing carbon microparticles or the like. A developing bias is applied to the development roller 31.

Also, the layer thickness regulation blade 32 is located in the vicinity of the development roller 31. The layer thickness regulation blade 32 is provided with a pressure portion 40 of a semicircular cross section made of insulating silicone rubber. The pressure portion 40 is provided at the tip of a blade body that is made of a metallic leaf spring material. The layer thickness regulating blade 32 is supported by the development cartridge 28 in the vicinity of the development roller 31 and is configured such that the pressure portion 40 is pressed onto the development roller 31 by the elastic force of the blade body.

The toner released from the toner supply opening 37 is supplied to the development roller 31 by the rotation of the toner supply roller 33 and, at this time, is friction charged between the toner supply roller 33 and the development roller 31. Furthermore, along with the rotation of the development roller 31, the toner supplied onto the development roller 31 enters between the pressure portion 40 of the layer thickness regulation blade 32 and the development roller 31, where it is further sufficiently friction charged, and is carried on the development roller 31 as a thin layer of a fixed thickness.

The drum cartridge 26 includes the photosensitive drum 27 as an image carrier, a scorotron type charger 29, the transfer roller 30 and the like.

The photosensitive drum 27 is located at a side position of the development roller 31, in such a way as to be rotatable clockwise. The photosensitive drum 27 is opposed to the development roller 31. A drum body of the photosensitive drum 27 is grounded. A surface portion of the photosensitive drum 27 is formed from a positively chargeable photosensitive layer made of polycarbonate and the like.

The scorotron type charger 29 is spaced a predetermined distance away from the photosensitive drum 27 in such a way as not to make contact with it. The scorotron type charger 29 is disposed about 30 degrees above a horizontal direction of the photosensitive drum 27. Also, the scorotron type charger 29 is a scorotron type charger for positive charging that generates a corona discharge from its charging wire, which is made of tungsten or the like. The scorotron type charger 29 uniformly charges the surface of the photosensitive drum to a positive polarity.

The surface of the photosensitive drum 27, along with the rotation of the photosensitive drum 27, is first positively charged uniformly by the scorotron type charger 29. Thereafter, based on image data input from the exterior, the surface of the photosensitive drum 27 is exposed by rapid scanning accompanied by the turning on and off of a laser beam from the scanner unit 16, thus forming an electrostatic latent image based on the image data.

Then, the positively charged toner borne on the development roller 31, when opposing and coming into contact with the photosensitive drum 27 due to the rotation of the development roller 31, is supplied to the electrostatic latent image, which is formed on the surface of the photosensitive drum 27. The electrostatic latent image is an exposed portion of the uniformly positively charged surface of the photosensitive drum 27, which has been exposed by the laser beam and lowered in potential. The supplied toner is selectively borne to thereby make the electrostatic latent image a visible image, thereby achieving reversal development.

The transfer roller 30 is disposed below the photosensitive drum 27 in such a way as to be opposed to the photosensitive drum 27. The transfer roller 30 is supported by the drum cartridge 26 in such a way as to be rotatable counterclockwise. The transfer roller 30, having a metallic roller shaft covered with a roller made of an ionic conductive rubber material, is configured such that a transfer bias (transfer order bias) is applied thereto at the time of transfer. As a result, the visible image borne on the surface of the photosensitive drum 27 is transferred to the paper 3 while the paper 3 is passing between the photosensitive drum 27 and the transfer roller 30.

The fixing unit 18, which is provided behind the process cartridge 17, includes a heating roller 41 and a pressure roller 42.

The heating roller 41 includes a metal pipe, a surface of which is coated with a fluorine resin, and a tungsten halogen lamp for heating inside the metal pipe. The heating roller 41 is rotary driven by an input of power from a motor (not shown). The pressure roller 42 is disposed below and opposite the heating roller in such a way as to press the heating roller 41. The pressure roller 42, which is configured by covering a metallic roller shaft with a roller made of a rubber material, is driven as the heating roller 41 is rotary driven.

In the fixing unit 18, the toner transferred onto the paper 3 at the transfer position is thermally fixed to the paper 3 while the paper 3 is passing between the heating roller 41 and the pressure roller 42. The paper 3 having the toner fixed thereto is conveyed to a paper discharge unit 70 extending upward. The paper 3 conveyed to the paper discharge unit 70 is discharged onto a paper discharge tray 46 formed on the upper surface of the body casing 2 by a correction unit 75 provided in an upper end position of the paper discharge unit 70. The paper conveyance distance from the fixing unit 18 to the correction unit 75 is shorter than the length of the paper 3 in the conveyance direction.

For example, the paper conveyance distance from the fixing unit 18 to the correction unit 75 is set to be 85 mm or more and 95 mm or less.

(b) Paper Discharge Unit

Next, the paper discharge unit 70 will be described with reference to FIGS. 2 to 4.

Figure 3:
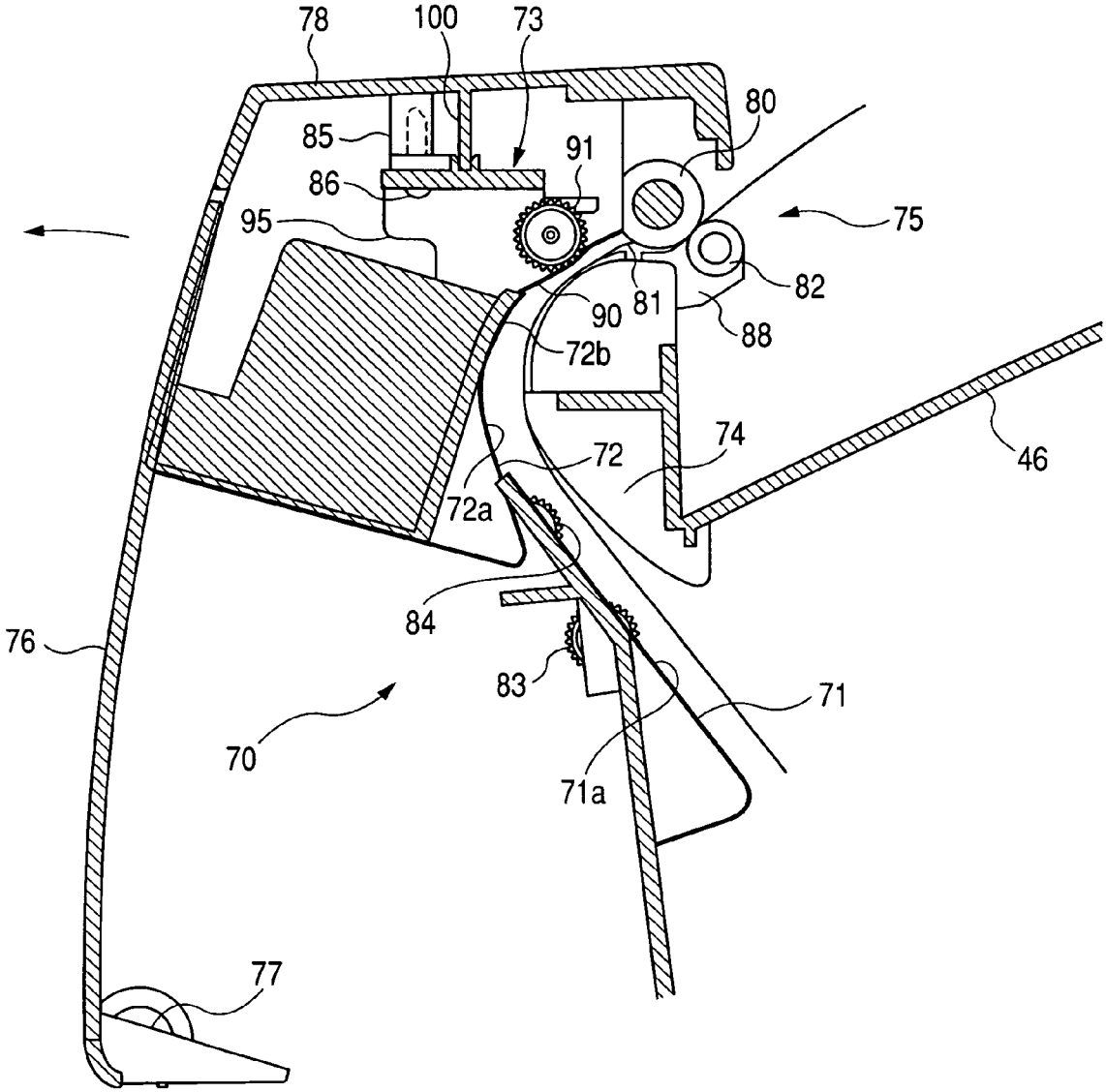
FIG. 3 is an enlarged sectional view of a paper discharge unit, which shows a section of a different position from FIG. 2.

FIG. 3 is an enlarged sectional view of the paper discharge unit 70, but it shows a section of a different position from FIG. 2.

As shown in FIGS. 2 and 3, the paper discharge unit 70 includes a first guide portion 71, which functions as a guide for guiding the paper 3 conveyed from the fixing unit 18; a second guide portion 72, which functions as a guide for curving the paper 3 conveyed from the first guide portion 71 into an approximately U-shape as seen from the side; a third guide portion 73, which functions as a guide member for guiding the leading edge of the paper 3 conveyed from the second guide portion 72 toward the correction unit 75; a fourth guide portion 74, which functions as a guide for guiding a surface of the paper while facing the first, second and third guide portions 71, 72 and 73; and the correction unit 75, which discharges the paper 3 onto the paper discharge tray 46 while correcting a curl of the paper 3.

The first guide portion 71 is provided in the vicinity of the downstream side of the fixing unit 18 in a paper conveyance direction (hereafter referred to as a conveyance direction). The first guide portion 71 includes a plane 71*a* for guiding the paper 3 upward and rearward. A first spur wheel 83 and a second spur wheel 84, which project from the plane 71*a* and come into contact with the paper 3 while rotating, are provided in the first guide portion 71 in such a way as to be rotatable about supports (not shown).

The second guide portion 72, being provided in the vicinity of the downstream side of the first guide portion 71 in the conveyance direction, includes a curved surface 72*a* for guiding the paper 3 upward while curving it into a U-shape as seen from the side. Also, the second guide portion 72 is integrally affixed to a rear cover 76 that is provided in such a way as to be pivotable about a rotating shaft 77 in the direction of the arrow in the figure. That is, by pivoting the rear cover 76 rearward, the second guide also moves rearward together with the rear cover 76, thereby exposing the fourth guide portion 74 and the like to the outside.

Figure 4:
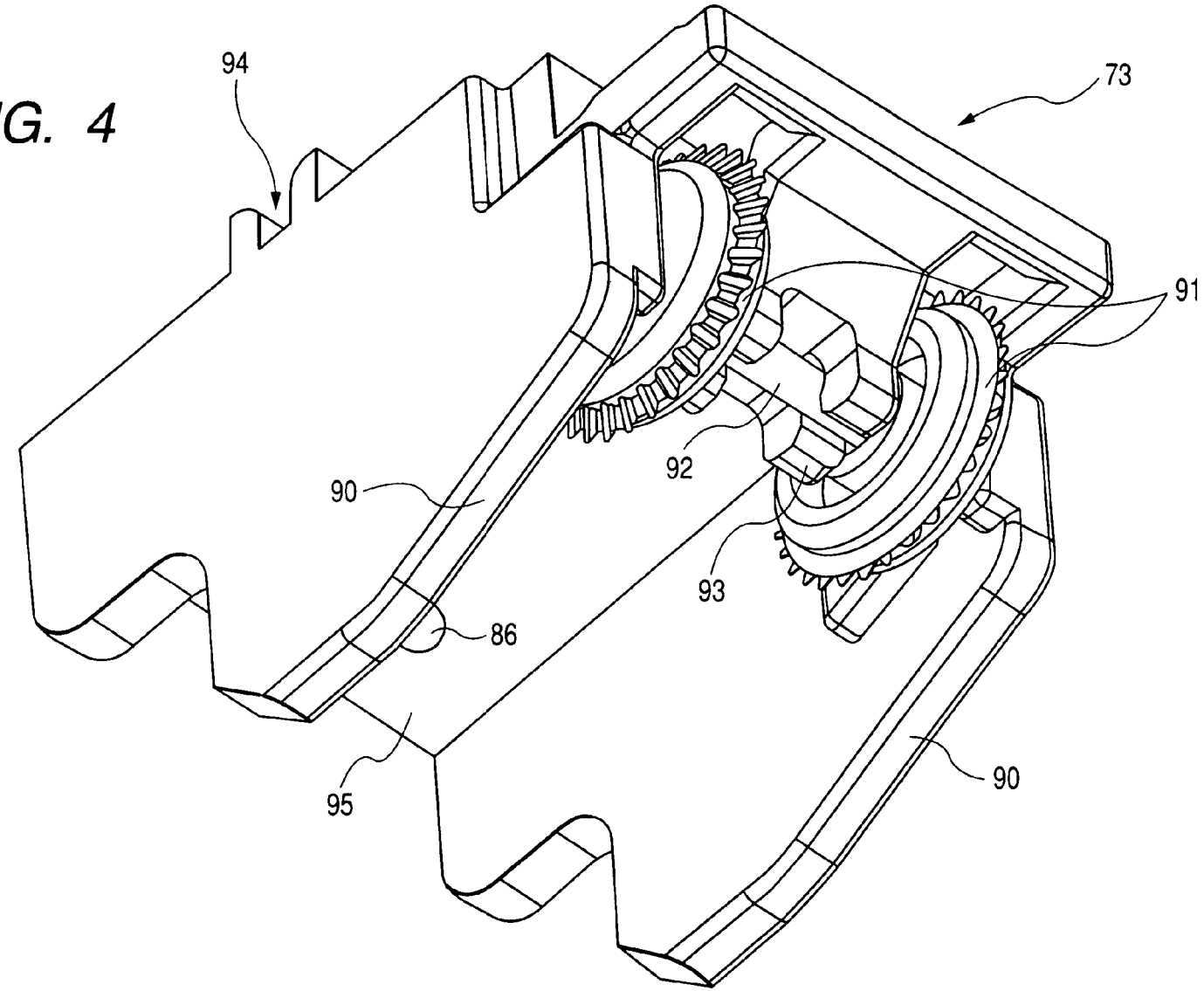
FIG. 4 is a perspective view of a third guide portion as seen from below.

FIG. 4 is a perspective view of the third guide portion 73 as seen from below.

The third guide portion 73 is disposed in the vicinity of the downstream side of the second guide portion 72 in the conveyance direction. As shown in FIG. 4, the third guide portion 73 includes guide ribs 90 for guiding the paper 3 and wheels 91 that are spur wheels.

The correction unit 75 includes a correction roller 80, which is driven by a motor (not shown) in the printer 1, and a first roller 81 and a second roller 82 functioning as rollers that are driven (rotated) while being pressed against the correction roller 80. The first roller 81 and the second roller 82 are rotabtably supported by a roller holder 88. The roller holder 88 is urged upward by a spring having one end affixed to the fourth guide portion 74. By this means, the first roller 81 and the second roller 82 are pressed against the correction roller 80. A rotating shaft of the correction roller 80 is rotatably supported on a not-shown bearing of an upper cover 78.

The fourth guide portion 74 integrally supports the paper discharge tray 46 that stacks the paper discharged by the correction unit 75.

(c) Third Guide Portion

Next, the third guide portion 73 will be described in more detail with reference to FIGS. 3 to 7.

As shown in FIG. 3, the third guide portion 73 is disposed downstream of a turning point 72*b*, at which the curved surface 72*a* has a maximum curvature, in the conveyance direction. The third guide portion 73 is disposed upstream of the correction roller 80 in the conveyance direction.

Figure 5:
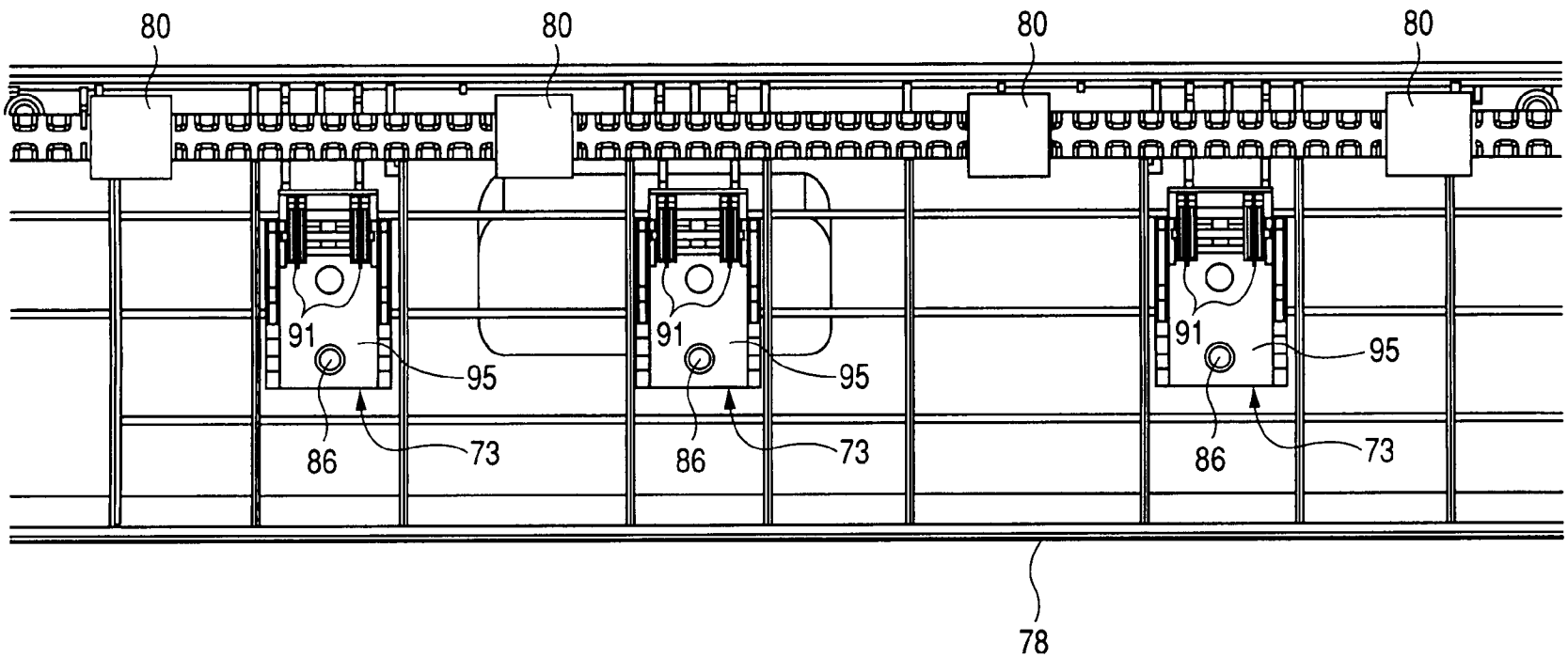
FIG. 5 is a plan view of an upper cover as seen from below.
Figure 6:
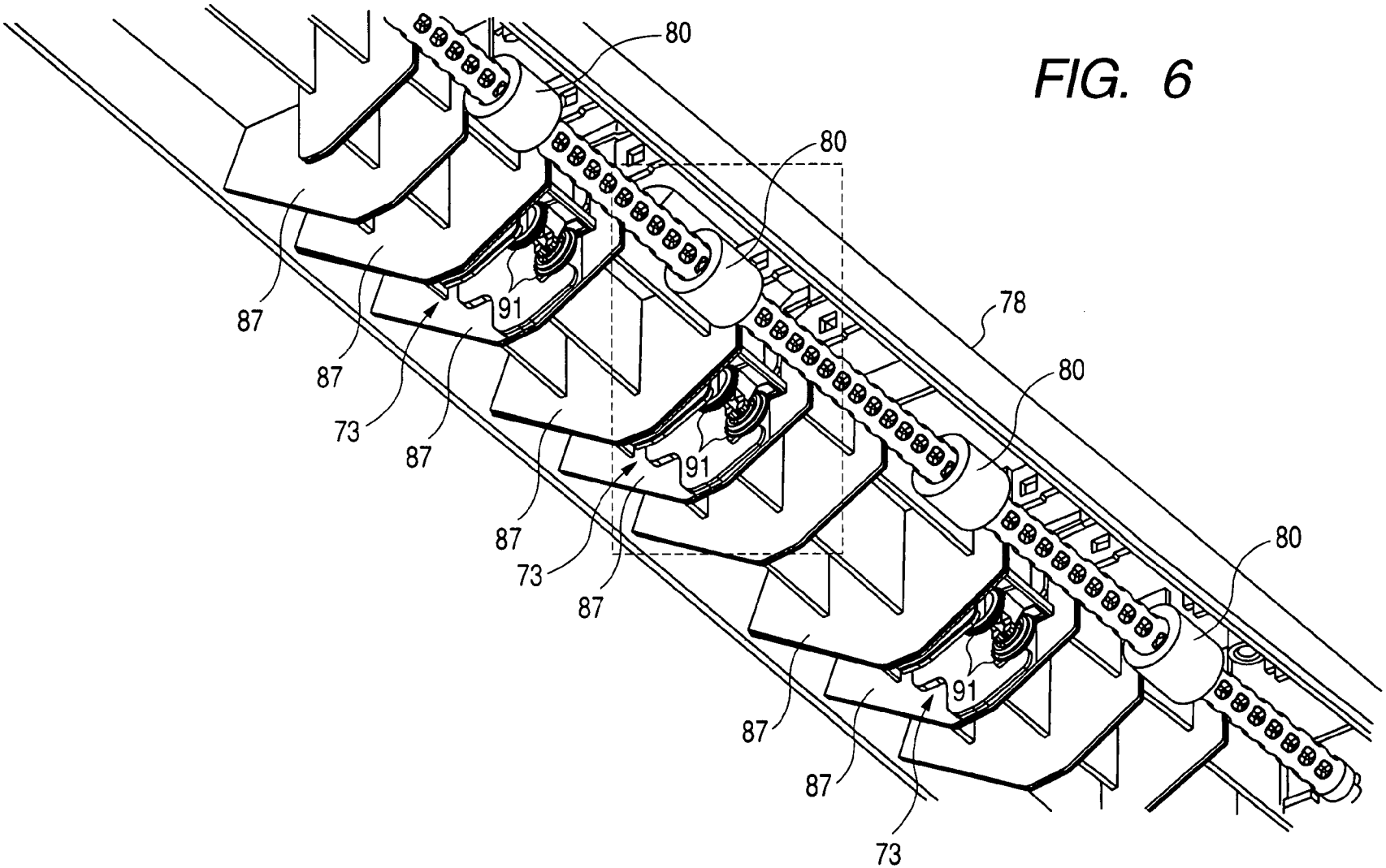
FIG. 6 is a perspective view of the upper cover as seen from below.

FIG. 5 is a plan view of the upper cover 78 as seen from below. FIG. 6 is a perspective view of the upper cover 78 as seen from below.

As shown in FIGS. 5 and 6, three third guide portions 73 are provided on the upper cover 78 at intervals along the longitudinal direction of the rotating shaft of the correction rollers 80.

As shown in FIG. 4, the third guide portion 73 includes a pair of wheels 91 and a holder 95 that supports the wheels 91 in a rotatable manner.

The pair of wheels 91 is connected by one rotating shaft 92. The rotating shaft 92 is rotatably supported by a bearing 93 provided on a lower side of the holder 95.

The holder 95 is provided with the bearing 93, which supports the rotating shaft 92 rotatably; a pair of downwardly projecting guide ribs 90, which guides the paper 3 toward the wheels 91; a regulation groove 94, which regulates the forward and rearward movement of the holder 95 on the upper side; and a screw hole (not shown) for screwing the holder 95 by a screw 86 to the upper cover 78.

The guide ribs 90 are made of a resin, such as polyacetal, which has a greater hardness than the first guide portion 71, the second guide portion 72 and the like which are formed of a mixture of polycarbonate and polystyrene. As shown in FIG. 4, the guide ribs 90 extend in such a way as to partially sandwich the pair of the wheels 91.

Also, the material of the guide ribs 90 is not limited to the resin as long as it is a material having a greater hardness than that of the first guide portion 71 and the second guide portion 72. For example, ceramics and metal are also acceptable.

As shown in FIGS. 3 to 5, the holder 95 is screwed to a boss 85 provided on the upper cover 78 by inserting the screw 86 in the screw hole.

A regulation rib 100 extending downward from the upper cover 78, as shown in FIG. 3, is fitted in the regulation groove 94. By this means, when the holder 95 is screwed to the upper cover 78, the forward and rearward movement of the holder 95 is regulated to facilitate the screwing.

As shown in FIGS. 5 and 6, three third guide portions 73 are disposed along the longitudinal direction of the rotating shaft of the correction rollers 80. Each of the three guide portions 95 is screwed by the screw 86 to the boss 85 of the upper cover 78.

Figure 7:
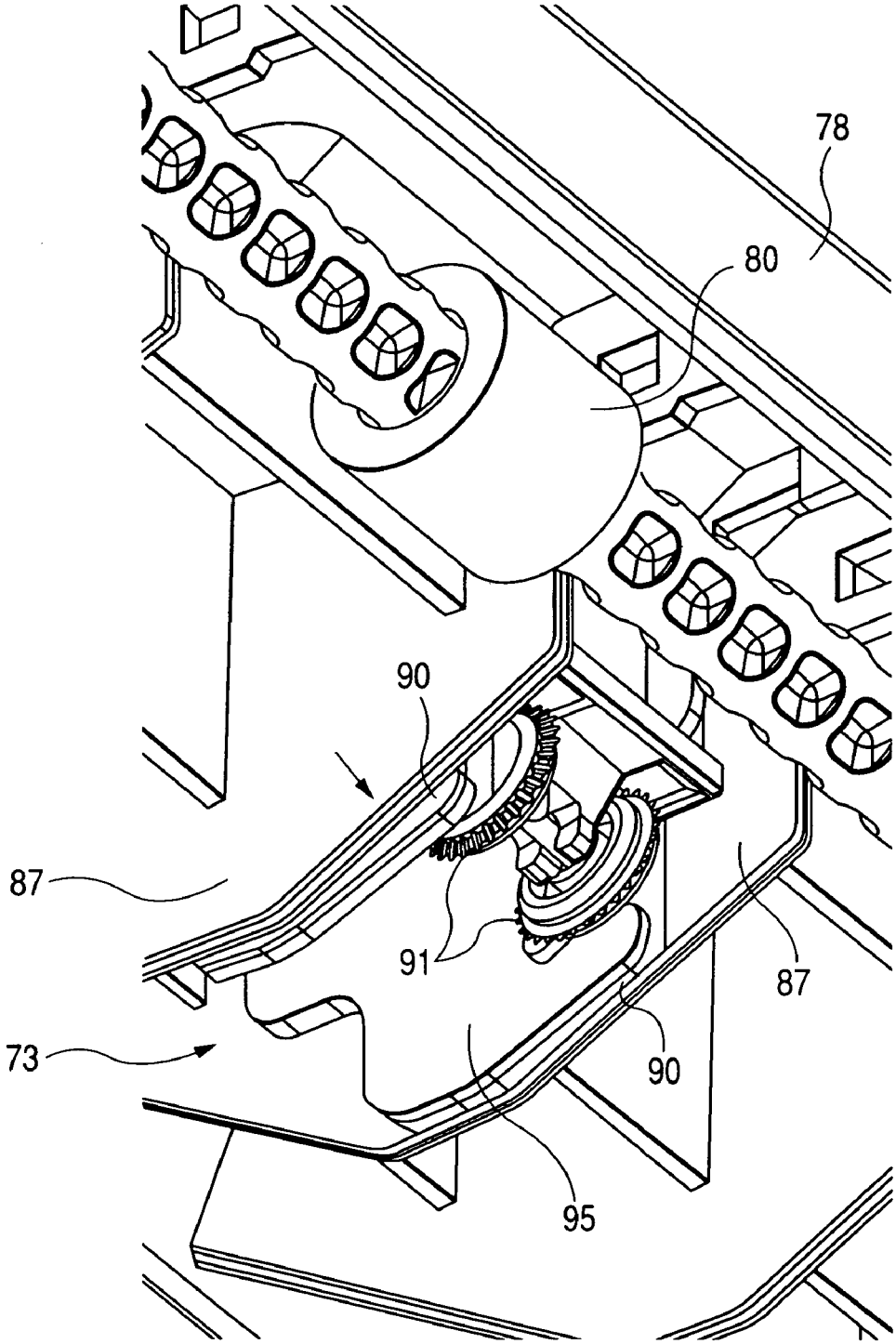
FIG. 7 is an enlarged view of a portion surrounded by a broken line in FIG. 6.

FIG. 7 is an enlarged view of the portion surrounded by a broken line in FIG. 6.

As shown in FIG. 7, the third guide portion 73 is disposed between upper ribs 87 extending downward from the upper cover 78.

As shown in FIG. 7, the guide ribs 90 of the holder 95 project farther than the upper ribs 87 in the direction of the arrow in the figure. Particularly, the amount of projection of the guide ribs 90 with respect to the upper ribs 87 increases toward the downstream side from the upstream side in the conveyance direction. The wheels 91 project downward from end portions of the guide ribs 90 near to the correction roller 80.

(d) Paper Discharge Operation

Next, a description will be given, with reference to FIG. 3, of an operation when the paper 3 passes through the paper discharge unit 70.

The paper 3 conveyed from the fixing unit 18 is conveyed toward the second guide portion 72 while being guided by the plane 71*a* of the first guide portion 71, the first spur wheel 83 and the second spur wheel 84. The paper 3 conveyed by the second guide portion 72 is conveyed toward the third guide portion 73 while being curved into an approximately U-shape as seen from the side along the curved surface 71*a*. The paper 3 conveyed to the third guide portion 73 is guided toward the wheel 91 while the surface of the paper 3 makes contact with the guide rib 90 at a lower angle. The paper 3 is further conveyed toward the correction unit 75 while making contact with the wheels 91. Between the correction unit 75 and the fixing unit 18, tension acts on the paper 3, which has reached the correction unit 75 and is nipped between the correction roller 80 and the first roller 81, whereby the paper 3 comes into contact with the fourth guide portion 74. When the trailing edge of the paper 3 leaves the fixing unit 18, as the tension no longer acts on the paper 3, the paper 3 is conveyed again toward the correction unit 75 while being guided by the first to third guide portions 71 to 73.

A description will be given of the advantages gained from the above configuration.

As the printer 1 includes the third guide portion 73 having the wheel 91 which guides the paper 3 toward the correction roller 80, the wheel 91, while rotating, smoothly guides the paper 3 to the correction roller 80. In the case where the surface of the paper 3 formed with the toner image is conveyed facing the wheel 91, on the upstream side of the correction roller 80 in the conveyance direction, the possibility that the paper 3 comes into strong sliding contact with the first to third guide portions 71 to 73, the upper rib 87 and the like, and that a toner adheres to the first to third guide portions 71 to 73, the upper rib 87 and the like is reduced. Consequently, it is possible to reduce the possibility that the paper 3 to be conveyed next becomes tainted and also the possibility that a toner accumulates on the upper rib 87 and the like into a lump, thereby causing a jam. As a result, it is possible to reduce a burden on a user.

As the third guide portion 73 includes the guide rib 90 which guides the paper 3 to the wheel 91, the leading edge of the paper 3 conveyed is first guided to the guide rib 90 and then guided to the wheel 91. Consequently, it is difficult for the leading edge of the paper 3 to strongly hit the wheel 91, thereby reducing the possibility of damaging the paper 3.

As the guide rib 90 is configured of a member having a greater hardness than the first to third guide portions 71 to 73, even though the leading edge of the paper 3 conveyed strongly hits the guide rib 90, the guide rib 90 is less likely to scrape than the first to third guide portions 71 to 73.

As the conveyance distance from the fixing unit 18 to the correction roller 80 is shorter than the length of the paper 3 in the conveyance direction, the curved surface 72*a* of the second guide portion 72 increases in curvature in comparison with a case in which the conveyance distance from the fixing unit 18 to the correction roller 80 is longer than the length of the paper 3 in the conveyance direction. There is the possibility that, when the leading edge or the trailing edge of the paper 3 passes the turning point 72*b* at which the curved surface 72*a* of the second guide portion 72 has a maximum curvature, the vicinity of the leading edge or the trailing edge of the paper 3 strongly hits the first to third guide portions 71 to 73, which are located upstream of the correction roller 80, the upper rib 87 and the like, and the toner image formed on the paper 3 adheres to the upper rib 87 and the like. In such a printer 1, therefore, the configuration of this aspect is useful.

What is claimed is:

1. An image forming apparatus comprising:

an image forming unit that forms an image on a surface of a conveyed sheet;

a guide that guides the sheet conveyed from the image forming unit;

at least one correction roller that is located downstream of the guide in a conveyance direction of the sheet, wherein the correction roller corrects a curl of the conveyed sheet when contacting the conveyed sheet, and the correction roller is supported on a cover that covers the image forming unit;

a plurality of rollers disposed opposite the correction roller along the periphery of the correction roller, the rollers nipping the sheet with respect to the correction roller; and a plurality of ribs which project from the cover to a side in which the plurality of rollers are disposed;

a guide member that is disposed between the plurality of ribs, the guide member comprising:

at least one wheel that guides the sheet being guided by the guide and conveyed toward the correction roller; and a guide rib that guides the sheet to the at least one wheel, wherein each one of the plurality of rollers is disposed on an opposite side of a sheet conveying path from the correction roller, and contacts a surface of the sheet, and the each roller is disposed in a position that is offset from a position in which the correction roller is disposed along an axial direction of the correction roller, wherein an amount of projection of the guide rib becomes larger along the conveyance direction of the sheet compared to an amount of projection of each of the plurality of ribs that project from the cover.

2. The image forming apparatus according to claim 1, wherein the at least one wheel comprises a plurality of wheels, and the at least one correction roller comprises a plurality of correction rollers, and each of the plurality of correction rollers is disposed at a first position along an axial direction of the plurality of correction rollers, and each of the plurality of wheels is disposed at a second position along an axial direction of the plurality of correction rollers, wherein the second position is different from the first position.

3. The image forming apparatus according to claim 1, wherein the image forming unit is disposed on a first side of a sheet conveying path, such that the image formed on the surface of the conveyed sheet that is conveyed through the sheet conveying path.

4. The image forming apparatus according to claim 3, further comprising a discharge unit located downstream of the image forming unit in a conveyance direction of the conveyed sheet, wherein the guide and the guide member form at least a portion of the discharge unit.

5. The image forming apparatus according to claim 3, wherein the image forming unit comprises a fixing unit that thermally fixes a toner image to the sheet while conveying the sheet, the guide guides the sheet conveyed from the fixing unit to the guide member, wherein the guide forms a portion of the sheet conveying path that has a U-shape when viewed in a side view, and a sheet conveyance distance from the fixing unit to the correction roller is shorter than a length of the conveyed sheet in the conveyance direction.

6. The image forming apparatus according to claim 5, wherein the sheet conveyance distance from the fixing unit to the correction roller is 85 mm to 95 mm.

7. The image forming apparatus according to claim 3, wherein the guide member comprises a plurality of guide members provided at intervals along a direction orthogonal to the conveyance direction.

8. The image forming apparatus according to claim 1, wherein the guide rib is formed of a material that has a greater hardness than a material of the guide.

9. The image forming apparatus according to claim 1, wherein the surface of the sheet, on which the image is formed, faces the at least one wheel while the conveyed sheet is conveyed toward the correction roller.

10. The image forming apparatus according to claim 1, wherein the at least one wheel comprises a pair of wheels spaced apart from each other, and the guide rib comprises a pair of guide ribs between which the pair of wheels are rotatably provided.

11. The image forming apparatus according to claim 10, wherein the pair of wheels project from the pair of guide ribs toward the conveyed sheet.

* * * * *